US006793155B2

(12) United States Patent
Huang

(10) Patent No.: US 6,793,155 B2
(45) Date of Patent: Sep. 21, 2004

(54) SPRAY GUN PRESSURE STABILIZER

(76) Inventor: Tiao-Hsiang Huang, No. 190, Chung Chen St., Shin Chuang City, Taipei Hsien (TW)

( * ) Notice: Subject to any disclaimer, the term of this patent is extended or adjusted under 35 U.S.C. 154(b) by 321 days.

(21) Appl. No.: 10/096,916

(22) Filed: Mar. 14, 2002

(65) Prior Publication Data

US 2003/0173419 A1 Sep. 18, 2003

(51) Int. Cl.[7] ..... B05B 1/28

(52) U.S. Cl. ..... 239/296; 239/290; 239/298; 239/525; 239/600

(58) Field of Search ..... 239/290, 296, 239/298, 433, 434, 461, 525, 526, 600

(56) References Cited

U.S. PATENT DOCUMENTS 4,392,617 A * 7/1983 Bakos et al. ..... 239/290
4,712,739 A * 12/1987 Bihn ..... 239/290
4,917,300 A * 4/1990 Gloviak et al. ..... 239/290
5,088,648 A * 2/1992 Schmon ..... 239/296
5,409,162 A * 4/1995 Sickles ..... 239/296

* cited by examiner

*Primary Examiner*—Steven J. Ganey
(74) *Attorney, Agent, or Firm*—Rosenberg, Klein & Lee

(57) ABSTRACT

A spray gun pressure stabilizer of the present invention comprises a nozzle, a spray head and a spray gun, the spray head is threaded to the front end of the spray gun and is composed of a spray hole and air outlets at the center portion axially, the front end of the spray gun is further composed of a recess for a de-pressure ring to sleeve thereon, the recess comprises an air outlet and a de-pressure hole, the recess also has a threaded inner hole to connect with the nozzle. The improvements of this invention is to form a pipe at center portion of the nozzle, and extending therefrom a block rim, the nozzle further comprises a circular rim with a number of air holes, so that air flows through the air holes will be blocked by the block rim, which de-presses the air to provide a stabilization of air output.

1 Claim, 6 Drawing Sheets

SPRAY GUN PRESSURE STABILIZER

BACKGROUND OF THE INVENTION

1. Field of the Invention

This invention relates to a spray gun, and more particular to a spray gun with an air pressure stabilizer.

2. Description of the Prior Art

Conventional spray guns are convenient and simplifying painting job. However, the air output pressure is too strong, which causes the spraying objects to bounce back and floating in the air, which pollutes the air and ruins the environment. Take one of the conventional arts as an example, as shown in FIGS. 4 and 5, the front end of a spray gun of the air output structure comprises a ring A, a nozzle B, a spray head C and a nut D. The nozzle B is located at the center of the front end of the spray gun. The inner top edge of the spray gun E has a wind hole E1 and air hole E2. The nozzle B comprises a circular rim B1 having air holes B2 thereon. The ring A is in a bowl shape having a rim A1 at the narrow side with air holes A2. The spray head C having a pair of air outlet C1 on the outer surface is secured with a nut D and interconnected with air passages C2. The spray head C has a spray hole C3 at its center portion, and a pair of air holes C4 at respective sides. When operating, the high pressure air goes through the wind hole E1 and the air hole E2 of the spray gun E, and spray out from the air holes A2 of the ring A and the air holes B2 of the nozzle B.

However, to operate the spray gun, the wind hole E1 has to be closed to collect the high pressure air in an air chamber, and the air is blown out through the spray hole C3 of the spray head C, the high speed and pressure causes painting objects to fly and to spread all over the space, that causes environmental pollution and is harmful to health.

SUMMARY OF THE INVENTION

It is the primary object of the present invention to provide a spray gun pressure stabilizer, which outputs a stabilized air pressure to evenly apply paint object on the surface.

It is another object of the present invention to provide a spray gun pressure stabilizer, which corresponds to the environment specification.

It is a further object of the present invention to provide a spray gun pressure stabilizer, which is cost effectiveness in manufacture.

DETAILED DESCRIPTION OF THE PREFERRED EMBODIMENT

Figure 1:
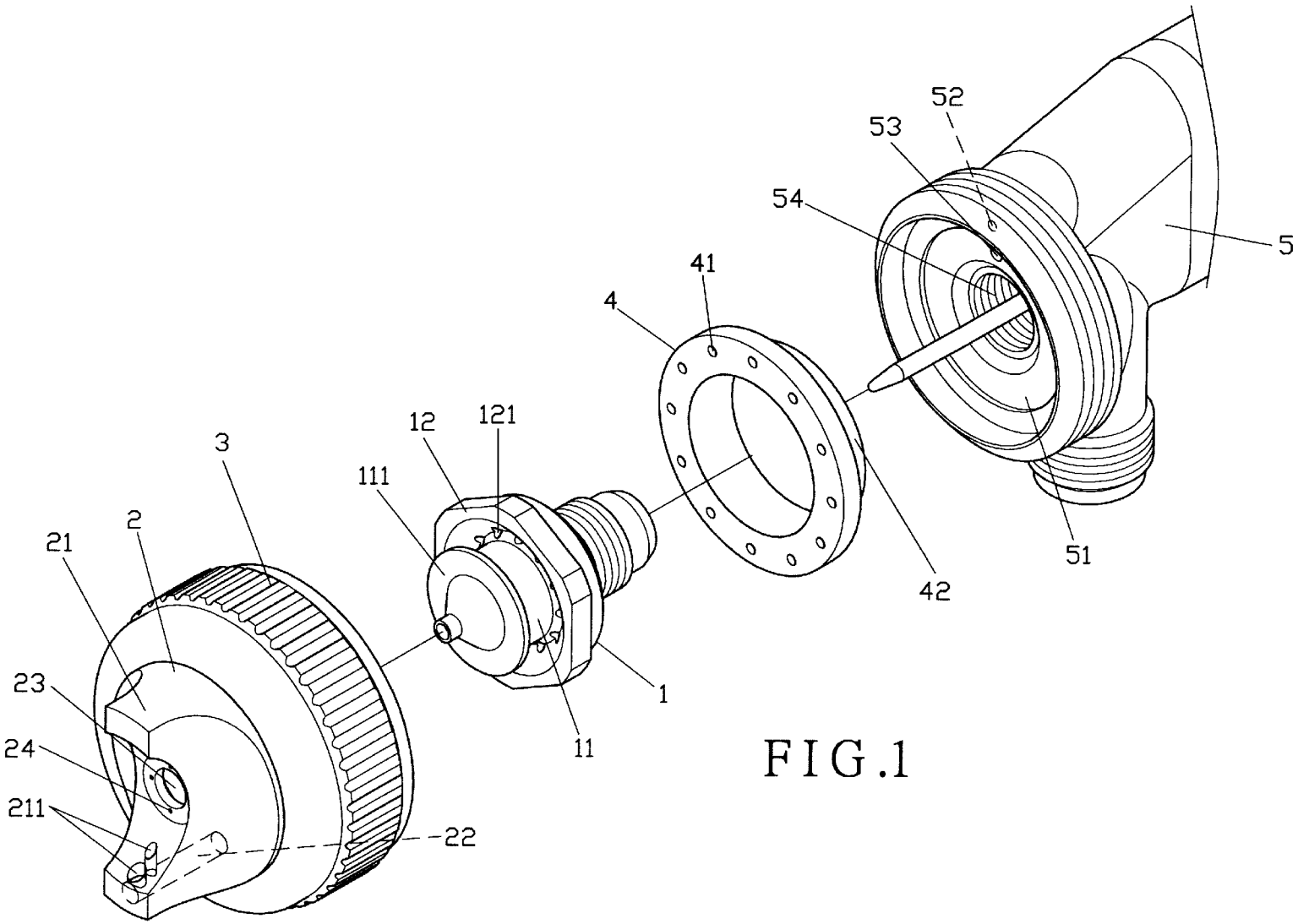
FIG. 1 is an exploded view of the present invention.

The spray gun pressure stabilizer of the present invention, as shown in FIG. 1, comprises a nozzle 1 equipped with a nut 3, a spray head 2, a de-pressure ring 4 and a spray gun 5.

The nozzle 1 comprises a hollow pipe 11 at the center portion with a block rim 111 at its surrounding outer front surface, and a circular rim 12 on the surface next to the block rim 111. The circular rim 12 comprises a number of air holes 121, and the rear end of the nozzle 1 is formed with threads for connection within the spray gun 5.

The spray head 2 is connected with the front end of the spray gun 5 and comprises a pair air outlets 21 interconnected with each other by an air passage 22, each air outlet 21 has wind holes 211, and the spray head 2 further comprises a spray hole 23 and a number of air outlets 24 at its center portion thereof.

The de-pressure ring 4 comprises a plurality of de-pressure holes 41 around its rim, and a flange 42 bulging out from its rear end.

The spray gun 5 has a recess 51 at its front end interconnecting a wind hole 52 and a de-pressure hole 53, the inner center portion is formed with a threaded hole 54 for connection of the nozzle 1.

Figure 2:
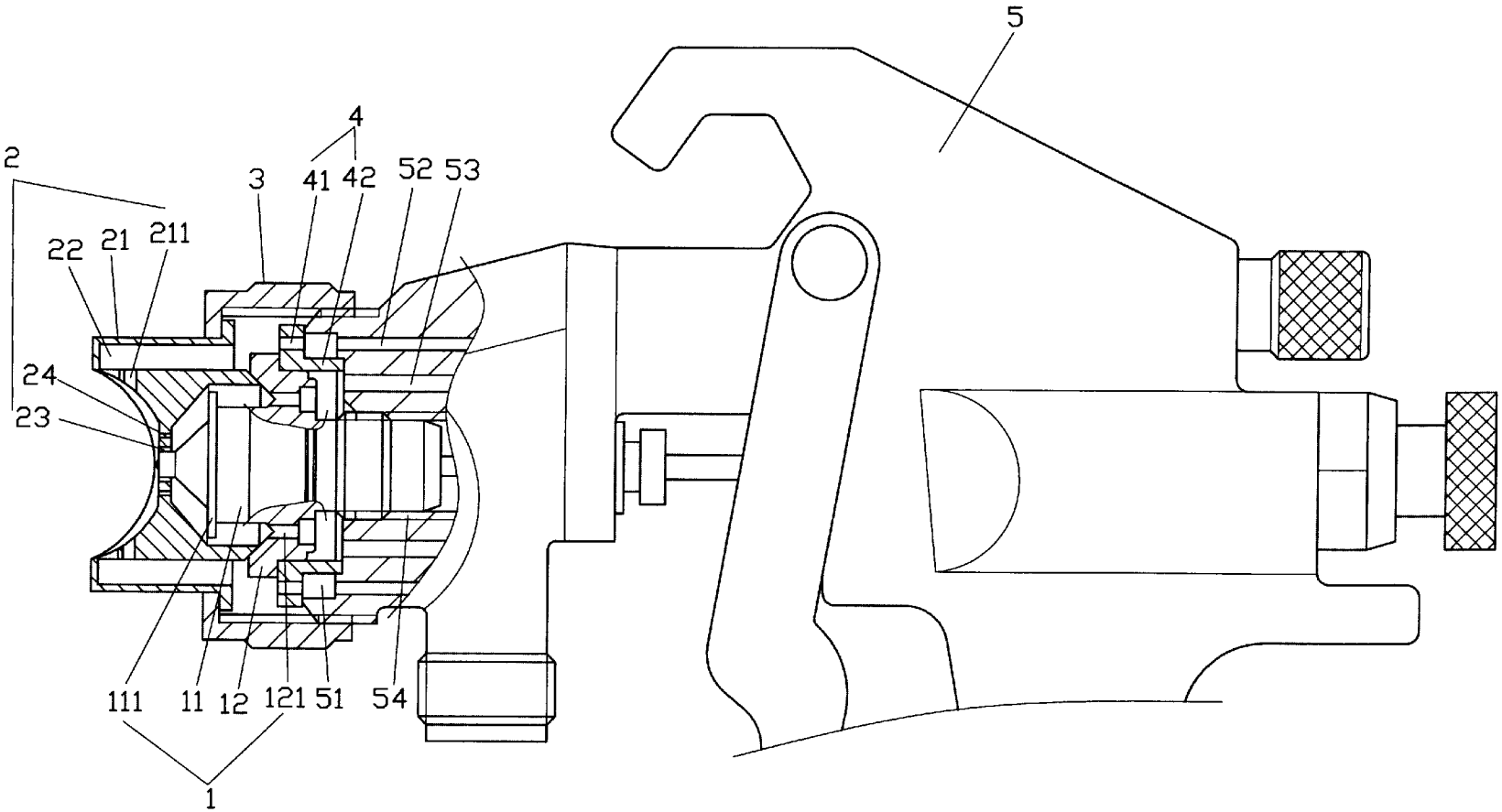
FIG. 2 is a side sectional view of the present invention.

To assemble the present invention, as shown in FIG. 2, the nozzle 1 is threaded into the threaded hole 54 of the spray gun 5, whereas the de-pressure ring 4 seals the circular rim 12 of the nozzle 1 and the recess 51 of the spray gun 5, the sealing forms a de-pressure chamber. The nut 3 on the spray head 2 is threaded onto the front threaded end of the spray gun 5 with the pipe 11 extending into the spray hole 23 of the spray head 2.

Figure 3:
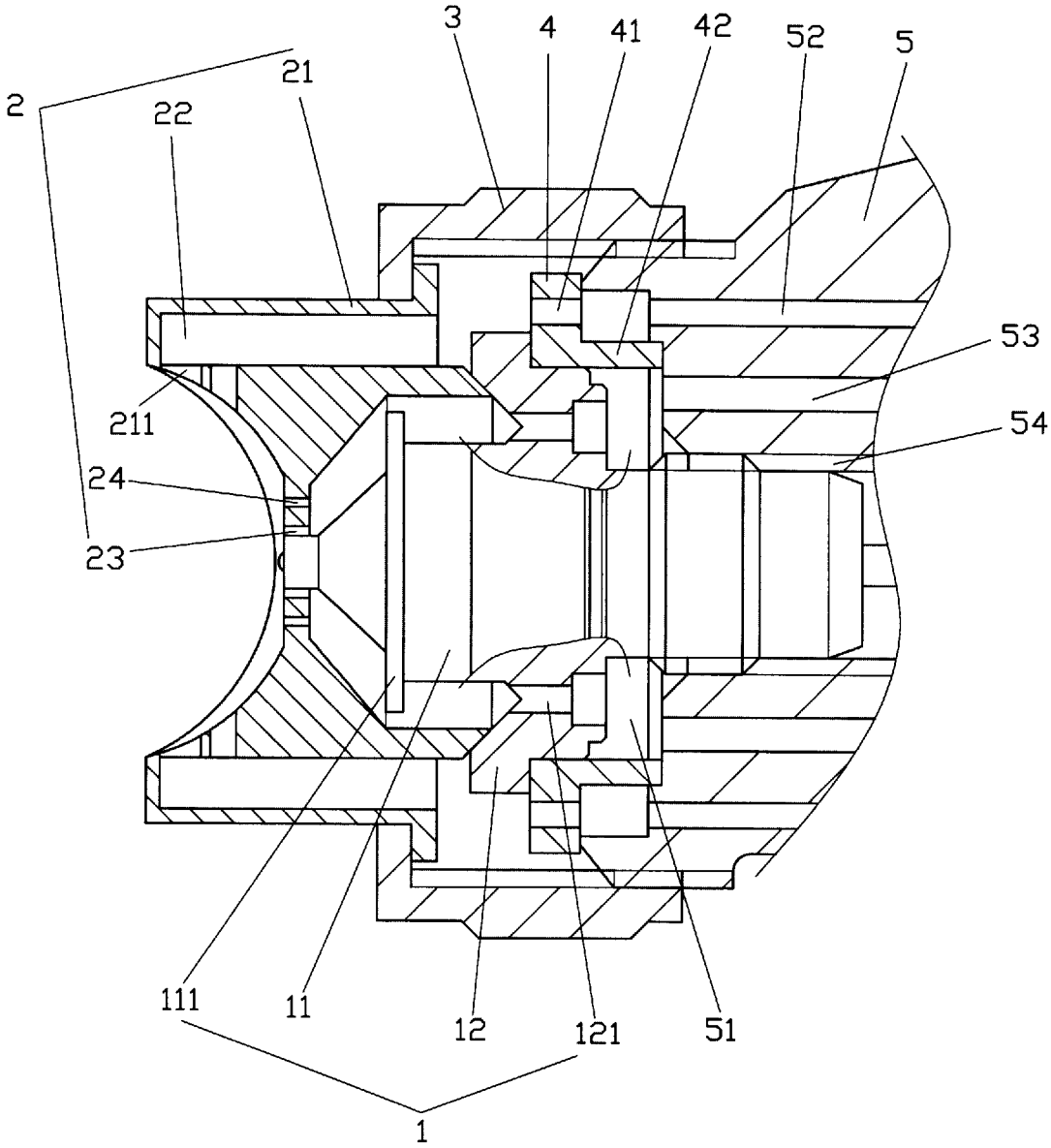
FIG. 3 is an enlarged sectional view of the present invention.
Figure 4:
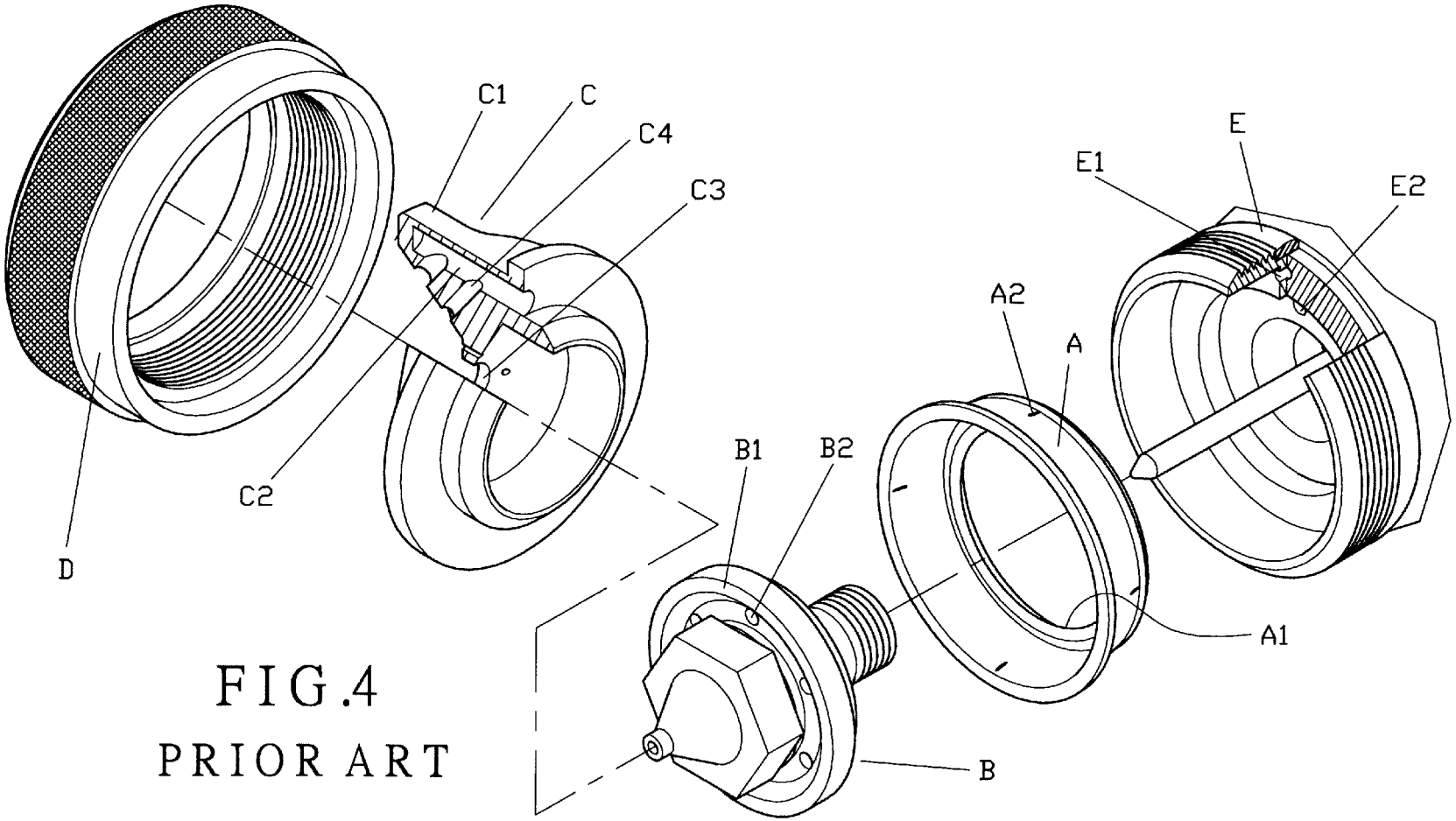
FIG.4 PRIOR ART
FIG. 4 is an exploded view of a prior art.
Figure 5:
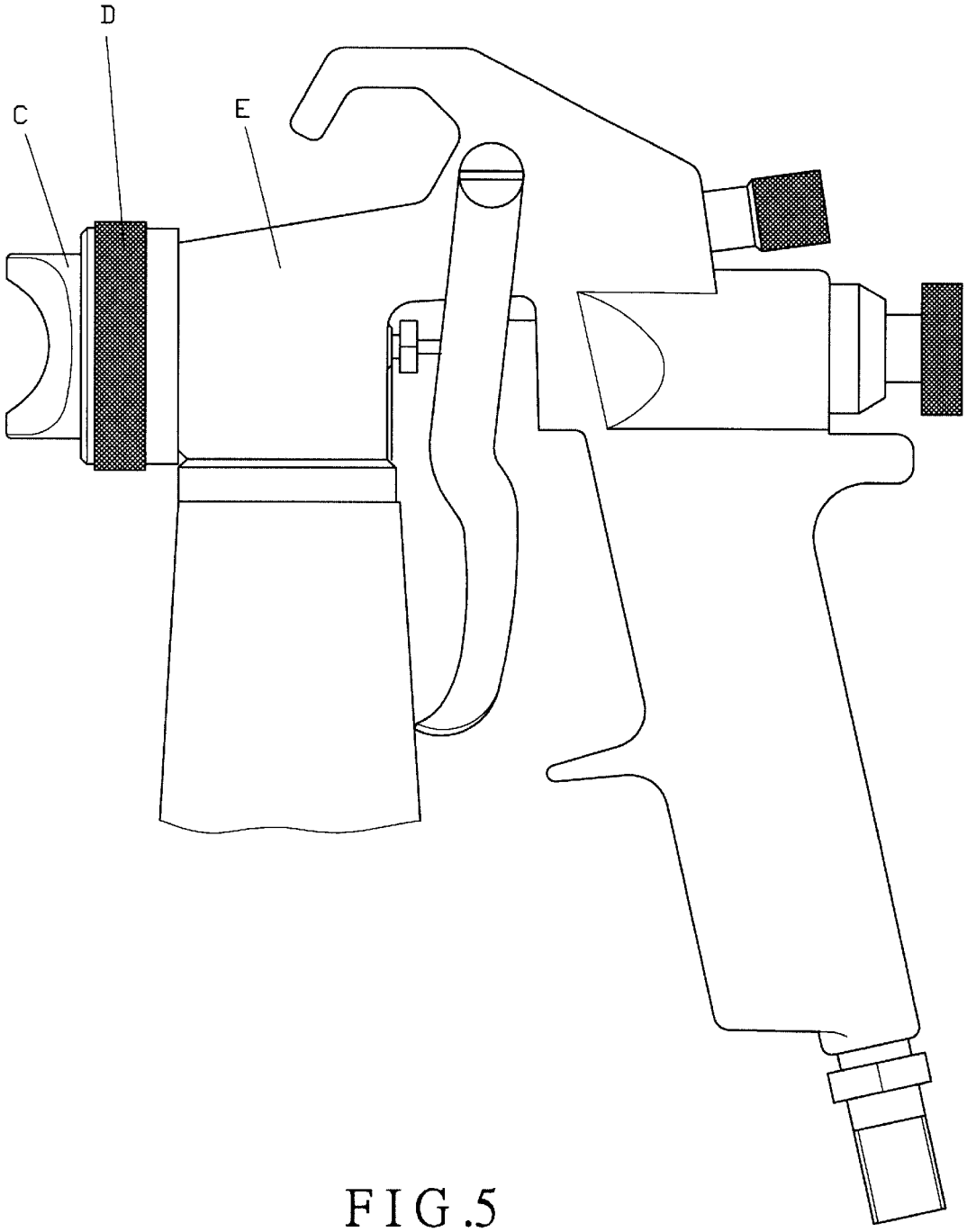
FIG.5 PRIOR ART
FIG. 5 is a side view of a prior art.
Figure 5A:
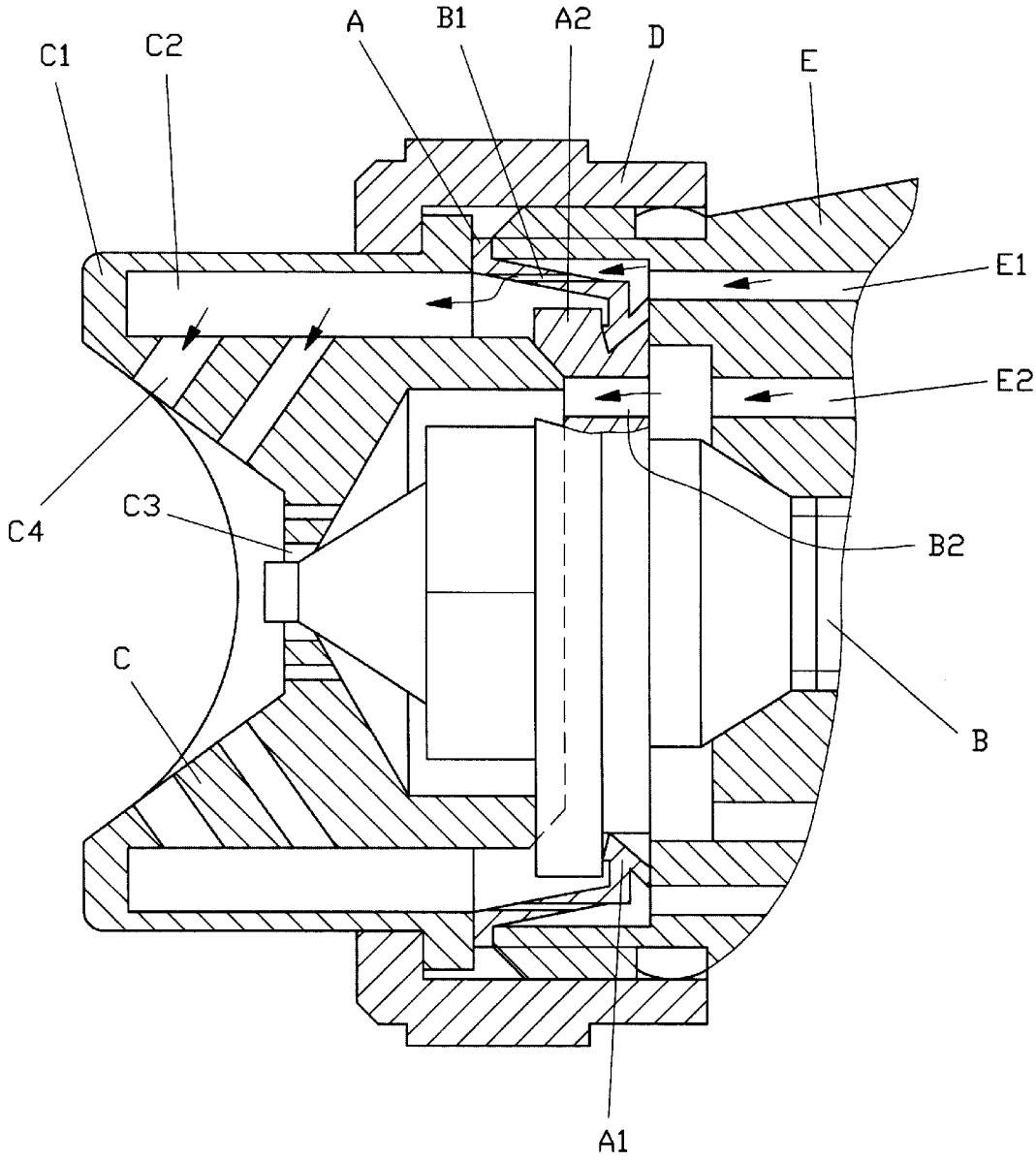
FIG.5A PRIOR ART
FIG. 5A is an enlarged view of FIG. 5.

When high pressure air is inputted into the spray gun 5, as shown in FIG. 3, it goes through the wind outlet 52 and the de-pressure hole 53, the air flows out through the air holes 121 will be blocked by the block rim 111 to slow down the pressure and output smoothly through the air outlets 24 and the spray hole 23 of the spray head 2, this de-pressure air is controlled not more than 10 Pollution Standards Index. (Any spray gun with the air pressure more than 10 Pollution Standards Index, is not in an environment standard.) The air released from the wind hole 52 will be gathered in the de-pressure chamber forming by the de-pressure ring 4 and will be released from the de-pressure holes 41. The de-pressure air will flow through the two air passages 22 of the air outlets 21 evenly.

It is therefore understood that the block rim 111 of the nozzle 1 may prevent air go out directly through the air outlets 24 and the spray hole 23 so that the pressure may be controlled under 10 Pollution Standards Index.

I claim:

1. A spray gun with pressure stabilization comprising:

a spray gun body having an outlet portion with a recess and a first wind hole formed therein, said recess having a threaded hole and a first de-pressure hole formed therein;

a de-pressure ring abutting said outlet portion of said spray gun body, said de-pressure ring having (a) a central trough opening in open communication with said threaded hole and said first de-pressure hole, (b) a plurality of second de-pressure holes surrounding said central through opening and being in fluid communication with said first wind hole, and (c) a flange circumscribing said central through opening and extending therefrom into said recess;

a nozzle having a longitudinally extended hollow pipe having a first end portion extending through said central through opening of said de-pressure ring with a first end of said nozzle being in fluid communication with said threaded hole of said recess, said nozzle having an opposing second end portion with an annular block rim coupled thereto, said nozzle having a circular rim abutting said dc-pressure ring and having a plurality of air holes formed therethrough and being in fluid communication with said first de-pressure hole; and, a spray head coupled to said outlet portion of said spray gun body and having a spray hole receiving a second end of said nozzle therein, said spray head having an annular central portion extending therefrom and abutting said circular rim of said de-pressure ring to define a first air flow channel internal to said annular central portion and in fluid communication with said air holes of said de-pressure ring and a second air flow channel external to said annular central portion and in fluid communication with said second dc-pressure holes of said de-pressure ring, said spray head having a plurality of air outlets surrounding said spray hole and in fluid communication with said first air flow channel, said spray head having a plurality of second wind holes spaced from said spray hole and in fluid communication with said second air flow channel, said annular block rim of said nozzle being disposed in said first air channel and being spaced from an inner wall of said spray head to define an air flow restriction for providing an air pressure drop thereacross.

* * * * *